US005907869A

United States Patent [19]

Bohn et al.

[11] Patent Number: 5,907,869

[45] Date of Patent: Jun. 1, 1999

[54] VEST THAT CARRIES OXYGEN

[76] Inventors: Elaine M. Bohn, P.O. Box 141; Carrie Hess, 849 N. 500 W.; Doris D. Bohn, P.O. Box 141, all of Malad, Id. 83252

[21] Appl. No.: 09/078,348

[22] Filed: May 13, 1998

[51] Int. Cl.[6] ..... A41B 1/00

[52] U.S. Cl. ..... 2/102; 2/69

[58] Field of Search ..... 2/102, 94, 85, 2/93, 108, 114, 247–250; 224/901, 249, 250, 246

[56] References Cited

U.S. PATENT DOCUMENTS

| | | | |
|---|---|---|---|
| 1,029,828 | 6/1912 | Schwartz | 2/102 |
| 1,054,426 | 2/1913 | Kuehn et al. | 2/102 |
| 1,131,054 | 3/1915 | Glassman | 2/85 |
| 1,243,828 | 10/1917 | Freedman | 2/102 |
| 2,620,479 | 12/1952 | Buck . | |
| 3,105,241 | 10/1963 | Allen | 2/102 |
| 4,168,544 | 9/1979 | Kallman | 2/94 |
| 4,564,957 | 1/1986 | Scharf | 2/102 X |
| 4,637,075 | 1/1987 | Ingrisano et al. | 2/94 |
| 4,825,471 | 5/1989 | Jennings | 2/94 |
| 5,075,900 | 12/1991 | Chittendon | 2/94 |
| 5,188,267 | 2/1993 | Sargent et al. . | |
| 5,265,782 | 11/1993 | McNamara | 2/94 X |
| 5,370,113 | 12/1994 | Parsons . | |

*Primary Examiner*—Gloria M. Hale
*Attorney, Agent, or Firm*—Hopkins Roden Crockett Hansen & Hoopes, PLLC

[57] ABSTRACT

An adjustable vest that permits the wearer to carry an oxygen bottle and other necessary attachments while having free use of both hands. An expandable bottle pouch on the back of the vest has an adjustable strap and buckle and closure flap that retain the bottle. A pocket on the pouch holds a gas metering device. Plastic loops retain a hose on the pouch and on the shoulder of the wearer. Multiple snap hooks connect the front and back of the vest to the wearer's belt loops.

18 Claims, 1 Drawing Sheet

VEST THAT CARRIES OXYGEN

TECHNICAL FIELD

This invention relates in general to a vest that carries an oxygen bottle, and, more particularly, to an adjustable vest having attachments for holding a metering device, hose, tools and other devices for persons requiring oxygen assisted breathing.

BACKGROUND OF THE INVENTION

People having lung problems often require supplemental oxygen. Conventionally, if these people want mobility while using supplemental oxygen, they must either pull a cart with an attached bottle or carry the bottle in a shoulder sling or a case carried in the hand. In each case, the person loses mobility of either one arm or one hand.

Oxygen containers which may be carried or towed typically contain between 164 and 415 liters (5 and 14 cubic feet) of oxygen. The typical flow rates can be controlled between 0.5 and 6 liters/min. The oxygen can be contained as a gas or liquid.

SUMMARY OF THE INVENTION

According to principles of the present invention, an adjustable vest permits the wearer to carry an oxygen bottle and other necessary attachments while having free use of both hands. An expandable bottle pouch has an adjustable strap and buckle and closure flap that retain the bottle. A pocket on the pouch holds a gas metering device. Plastic loops retains a hose on the pouch and on the shoulders of the wearer. Multiple snap hooks connect the front and back of the vest to the wearer's belt loops to keep the vest in place when bending over.

Other objects, advantages, and capabilities of the present invention will become more apparent as the description proceeds.

DETAILED DESCRIPTION OF THE INVENTION

Figure 1:
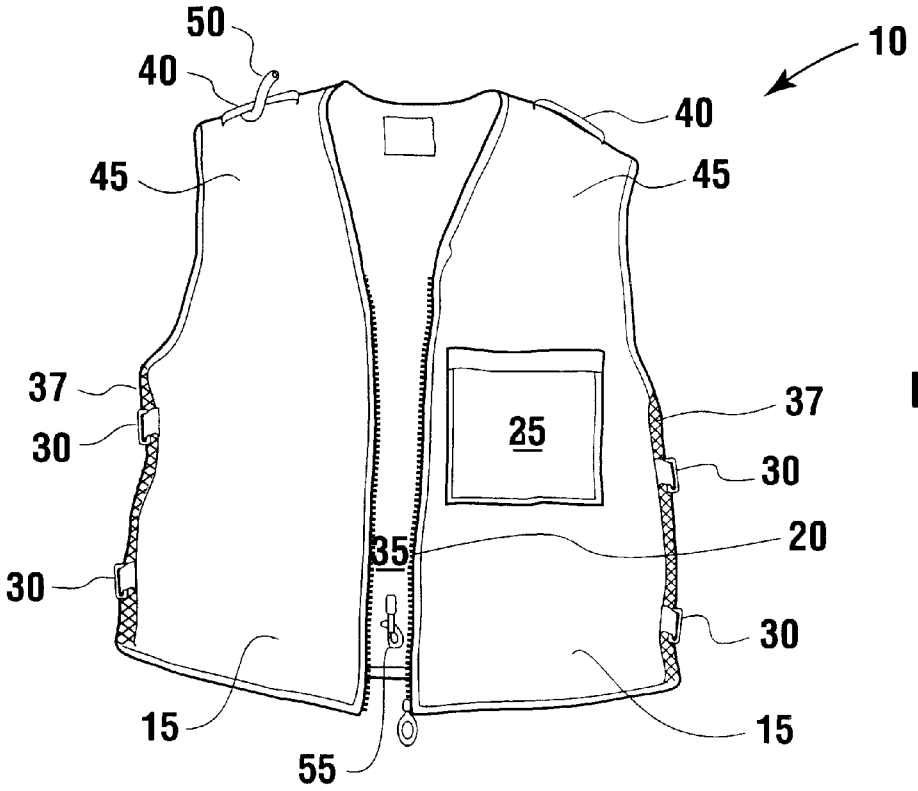
FIG. 1 is a front elevation of the vest of the present invention.

The vest 10 will be described by referring to FIGS. 1 and 2. FIG. 1 illustrates the front 15 of the vest having a closure such as a zipper 20, a pocket 25 and adjustable straps and buckles 30 that connect the front 15 of the vest 10 to the back 35. Cloth webbing 37 also connects the front 15 to the back 35 and provides ventilation. The pocket 25 is used to hold a wrench (not shown) that actuates the on-off gas valve, and an inhaler or other medical apparatus. The vest has a pair of hose loops 40 on the shoulder portions 45. The hose loops 40 prevent the hose 50 from slipping off the shoulder portion 45. FIG. 1 also illustrates an adjustable snap hook 55 on the inside of the back 35. This snap 55 hook hooks onto a pants belt loop to prevent the vest 10 from "riding up" on the wearer's back when he or she bends over.

Figure 2:
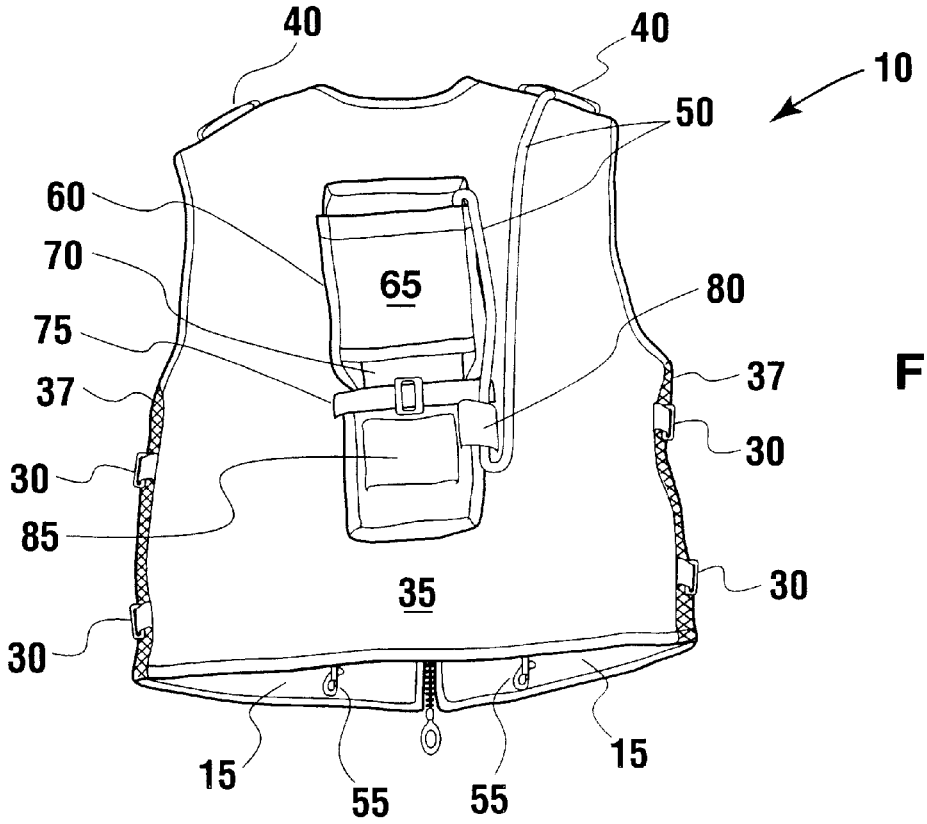
FIG. 2 is a back elevation of the vest of the present invention.

FIG. 2 illustrates the back 35 of the vest 10. The back 35 has a bottle pouch 60 having a closure flap 65 that retains the bottle and closes by a hook and pile closure 70. There is also an adjustable strap 75 that clamp's down on bottles of different shapes and diameters.

The cylinders for oxygen gas bottles are typically about 3.5 and 4.5 inches in diameter and 9 and 12" high. The liquid oxygen plastic containers are about 3" wide at the base, about 4" wide at the top and about 15" high. The pouch 60 accommodates all these sizes.

The newer models of metering devices are attached at the top of the bottle within the pouch. On this model, the hose 50 passes through pouch hose loop 80 and then up to the shoulder loop 40 as shown in FIG. 2.

Older metering devices are separate from the bottle. To accommodate this type of meter, a meter pocket 85 is attached to the pouch 60 and holds the separate gas pulsing meter. The meter sends a controlled pulse of oxygen gas to the user via tube 50 when the user inhales. Two additional belt snap hooks 55 are attached on each half of the vest front 15 to prevent the front of the vest from "riding up".

It is noted that the vest can be worn reversed for a user that is sitting in a seat having a seat back. This permits the user to drive a car, tractor or other vehicle in comfort. The vest adjustable straps and buckles 30 permit the user to wear the vest 10 over street clothes or over a coat in cool weather. The vest 10 permits the wearer to enjoy activities such as gardening, walking, hunting, fishing, snowmobiling, ATV riding, golfing, horseback riding, and other activities.

While the present invention has been described by reference to specific embodiments, it will be apparent that other alternative embodiments and methods of implementation or modification may be employed without departing from the true spirit and scope of the invention.

What is claimed is:

1. A garment for carrying an oxygen bottle, the garment comprising:

(a) a vest having a front and a back;

(b) an expandable pouch having a top portion with an opening formed in the top portion of the pouch, the pouch attached to the back of the vest;

(c) a flap attached to the back of the vest adjacent to the pouch opening;

(d) at least one belt loop snap hook attached to the vest;

(e) a pocket attached to the expandable pouch;

(f) a hose strap attached to the pouch; and (g) an adjustable strap attached to the pouch for holding different diameter oxygen bottles.

2. The garment of claim 1 further including multiple adjustable attachment means to connect the front to the back of the vest.

3. The garment of claim 2 wherein the adjustable attachment means is an adjustable belt and buckle.

4. The garment of claim 1 wherein the vest further includes:

(a) two shoulder portions; and, (b) a hose loop attached to each shoulder portion of the vest.

5. The garment of claim 1 further including a breast pocket attached to the front of the vest.

6. The garment of claim 1 wherein the vest front includes:

(a) an attachment means; and, (b) two halves connected by the attachment means.

7. The garment of claim 6 wherein the attachment means is a zipper.

8. A garment for carrying an oxygen bottle the garment comprising:

(a) a vest having a front and a back;

(b) an expandable pouch having a top portion with an opening formed in the top portion of the pouch, the pouch attached to the back of the vest;

(c) a flap attached to the back of the vest adjacent to the pouch opening;

(d) an adjustable strap and buckle attached to the pouch wherein the strap retains different diameter oxygen bottles;

(e) at least one adjustable belt loop snap hook attached to the vest; and, (f) a pocket attached to the expandable pouch.

9. The garment of claim 8 further including a hose strap attached to the pouch.

10. The garment of claim 8 further including multiple adjustable attachment means to connect the front to the back of the vest.

11. The garment of claim 10 wherein the adjustable attachment means is an adjustable belt and buckle.

12. The garment of claim 8 wherein the vest further includes:

(a) shoulder portions; and, (b) a hose loop attached to the shoulder portions of the vest.

13. The garment of claim 8 further including a breast pocket attached to the front of the vest.

14. The garment of claim 8 wherein the vest front includes:

(a) an attachment means; and, (b) two halves connected by the attachment means.

15. The garment of claim 14 wherein the attachment means is a zipper.

16. A garment for carrying an oxygen bottle, the garment comprising:

(a) a front and back of the vest having shoulder portions;

(b) an expandable pouch having a top portion with an opening formed in the top portion of the pouch, the pouch attached to the back of the vest;

(c) a flap attached to the back of the vest adjacent to the pouch opening;

(d) an adjustable strap and buckle attached to the pouch wherein the strap retains different diameter oxygen bottles;

(e) multiple adjustable belt loop snap hooks within the vest;

(f) a pocket attached to the expandable pouch; and, (g) multiple adjustable straps and buckles that connect the front to the back of the vest.

17. The garment of claim 16 further including a hose strap attached to the pouch.

18. The garment of claim 16 wherein the vest further includes:

(a) shoulder portions; and, (b) a hose loop attached to the shoulder portions of the vest.

* * * * *